US005100439A

United States Patent [19]

Kemp

[11] Patent Number: 5,100,439

[45] Date of Patent: Mar. 31, 1992

[54] FASTENING MEANS FOR ELECTRONIC AIR CLEANER CELLS

[75] Inventor: Stephen J. Kemp, St. Paul

[73] Assignee: Honeywell Inc., Minneapolis, Minn.

[21] Appl. No.: 648,506

[22] Filed: Jan. 30, 1991

[51] Int. Cl.[5] ..... B03C 3/00

[52] U.S. Cl. ..... 55/143; 55/145; 29/DIG. 77; 29/890.04; 29/512

[58] Field of Search ..... 55/140, 141, 143, 145; 411/500, 501; 29/512, 890.04, 890.044, DIG. 77

[56] References Cited

U.S. PATENT DOCUMENTS

| | | | |
|---|---|---|---|
| 3,066,066 | 10/1961 | Grossen et al. | 55/145 |
| 3,143,403 | 8/1964 | Swensen | 55/156 |
| 3,188,784 | 6/1965 | Nodolf | 55/105 |
| 4,239,713 | 12/1980 | Brif | 29/523 |
| 4,341,537 | 7/1982 | Rodgers | 55/139 |

FOREIGN PATENT DOCUMENTS

| | | | |
|---|---|---|---|
| 155913 | 3/1954 | Australia | 55/145 |
| 2072554 | 10/1981 | United Kingdom | 29/890.044 |

*Primary Examiner*—Bernard Nozick
*Attorney, Agent, or Firm*—Ian D. MacKinnon

[57] ABSTRACT

A fastening means for an electronic air cleaner. The air cleaner containing an air cleaner collector section. The air cleaner collector section is a series of high voltage and low voltage plates which are held by cell expansion tubes. On either end of the air cleaner collector section, end plates are placed in order to hold the air cleaner collector section in place. Flare tubes are passed through the end plates and the cell expansion tubes and are flared in order to fasten the end plates in place, thereby fastening the air cleaner collector section.

2 Claims, 4 Drawing Sheets

FASTENING MEANS FOR ELECTRONIC AIR CLEANER CELLS

FIELD OF THE INVENTION

This invention is in the field of electronic air cleaner cells. More specifically, this invention is a means for fastening the air cleaner collector section to the end plates of the cell.

BACKGROUND OF THE INVENTION

Electronic air cleaners have been in existence since the early 1960's. This field is now well developed and highly competitive. Due to the extent to which air cleaners have been developed, any improvement in cost or reliability to the air cleaner is significant.

Electronic air cleaner cells are constructed by joining air cleaner collector sections to end plates of the cells. Previously this was accomplished with screws from the end plates into the expansion tubes which support the collection plates. For smaller cells, a second method was used which consisted of passing a threaded rod through the first end plate, the collector expansion tube and, finally, the second end plate. A washer and nut was added to secure the assembly.

Air cleaners manufactured utilizing the method of placing a screw through the end plates into the cell expansion tubes have problems with screws coming loose due to variations in the required driving torque. The screws also come loose during handling or washing. At this time, this method is also expensive, as this method of manufacture requires the use of a human operator. Further, if the air cleaner cell were to be disassembled, the expansion tubes would be irreparable, requiring the air cleaner collection cell to be replaced. This is partially due to the fact that once the screws are threaded into the expansion tube, removed and replaced in the same expansion tube, the screw would not be able to achieve the same torque as when originally assembled.

The most significant problem created through use of the screws is torsional stress imparted on the cell expansion tubes by the screws. These torsional stresses reduce cell quality by warping the collection plates. The screw heads also tend to "walk" or shift on the end plate when tightened, placing lateral forces upon the collection plates, also warping the collection plates. This is significant as the air cleaner cell has every other collection plate charged to 4,075 volts dc. The remaining collection plates are grounded. Therefore, if the collection plates are warped, arcing may occur between the plates, reducing the effectiveness of the air cleaner.

The second prior art manner of assembly involves the use of a tie rod. This method of manufacture consists of passing a threaded rod through the first end plate, the cell expansion tube and, finally, through the second end plate. The tie rod was fastened in place by adding a washer and a nut. The use of a tie rod eliminates some of the problems with torsional stresses applied to the device. However, the tie rod is expensive, requires manual assembly and is also susceptible to the nuts loosening due to variations in the required driving torque, handling and washing. The tie rod is used primarily on small air cleaner cells due to the costs of the tie rod assembly. The screws impose such a severe torque upon the cell expansion tubes that screws are not practical with the smaller cells; the failure rate of the smaller cells manufactured with screws being too high. However, due to the cost of the tie rod assembly, the tie rods are not utilized where the failure rate of the air cleaner cells does not offset the costs.

Examples of electronic air cleaners can be found in U.S. Pat. No. 3,143,403 by Elmer H. Swensen and in U.S. Pat. No. 3,188,784 by K. M. Nodolf.

SUMMARY OF THE INVENTION

In accordance with the invention, a tube having a flared end is inserted through the first end plate, then through the collector section expansion tube and, finally, through the second end plate. The end of the tube which was passed through the second end plate is then flared.

With this structure there are no torsional forces or lateral forces imparted upon the cell expansion tubes and collection plates. This lessens the occurrence of warping of the collection plates. An electronic air cleaner, in accordance with this invention, has noticeably lower fallout rates (failure rates) for the air cleaner collector section.

DESCRIPTION OF THE PREFERRED EMBODIMENT

Figure 2A:
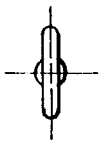
FIG. 2*a* is an end view of the tie rod of FIG. 2.
Figure 2:
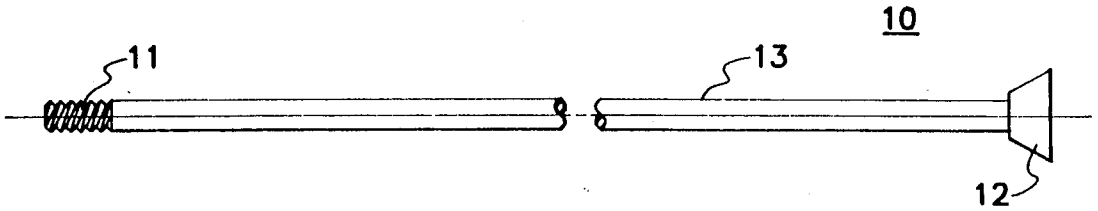
Fig. 2 (Prior Art)
FIG. 2 demonstrates a "prior art" tie rod utilized to fasten air cleaner cell assemblies.
Figure 1:
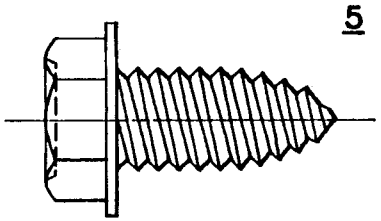
Fig. 1 (Prior Art)
FIG. 1 demonstrates the "prior art" screw utilized to fasten air cleaner cell assemblies.

Screw 5 of FIG. 1 is utilized to fasten the end plates to the air cleaner collector section in the "prior art" assembly. Tie rod 10 of FIGS. 2 and 2*a* is utilized to fastened the end plates to the air cleaner collection section in the "prior art" assembly for smaller cell assemblies. Tie rod 10 consists of a solid aluminum rod 13 which has its top end coined to a flat shape. Bottom end 11 is threaded in order to receive a nut.

Figure 3:
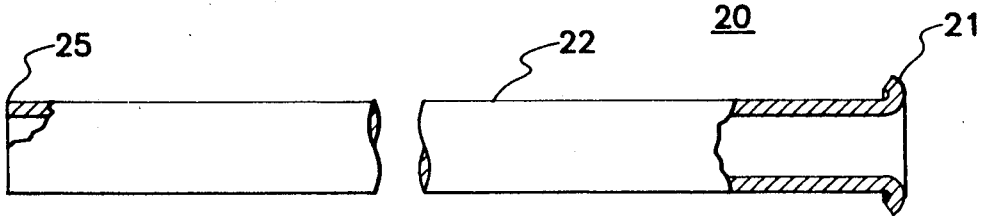
FIG. 3 is the flare tube.

Flare tube 20 of FIG. 3 is utilized for fastening the air cleaner collector section 32 for this invention. Flare tube 20 consists of a hollow tube 22 having a first end 21 which is flared. Flare tube 20 is made out of 3003-H12 aluminum. The opposing end 25 is the same diameter as the remainder of the tube, however, opposing end 25 is later flared during assembly.

Figure 4A:
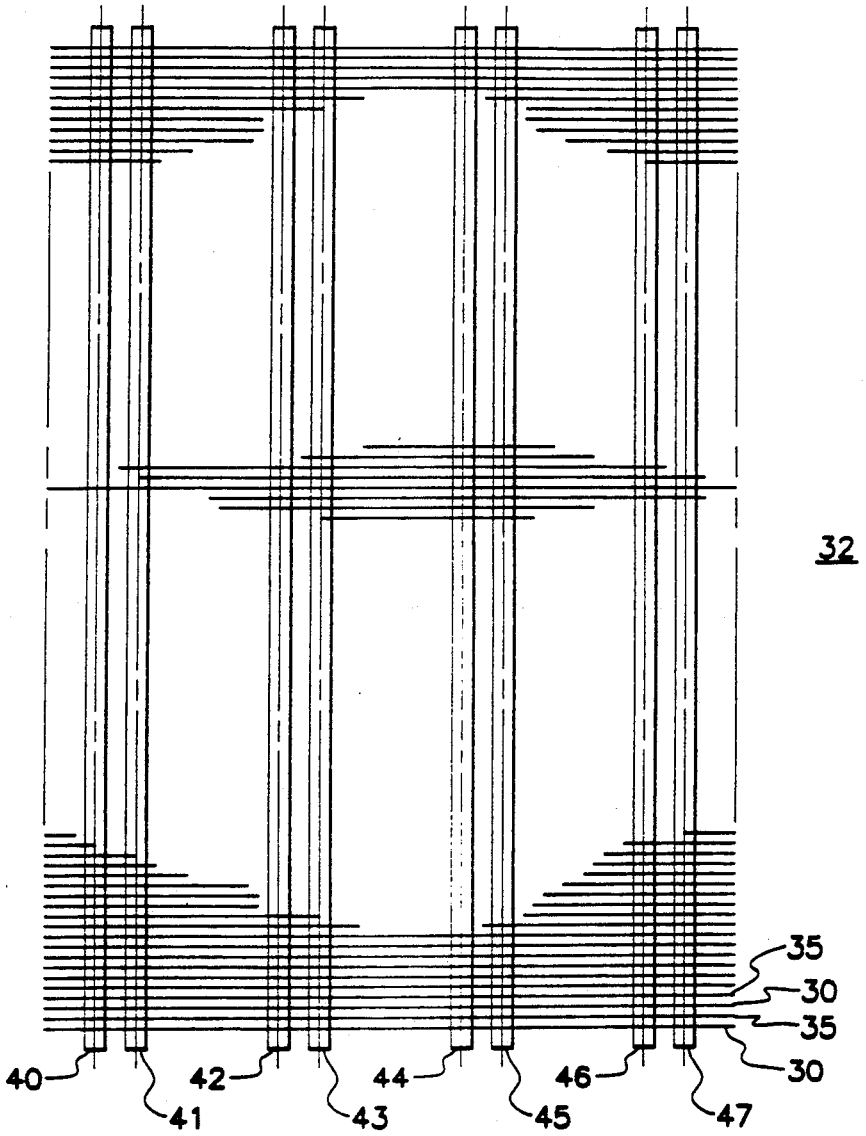
FIG. 4*a* is the front view of the air cleaner collector section.
Figure 4:
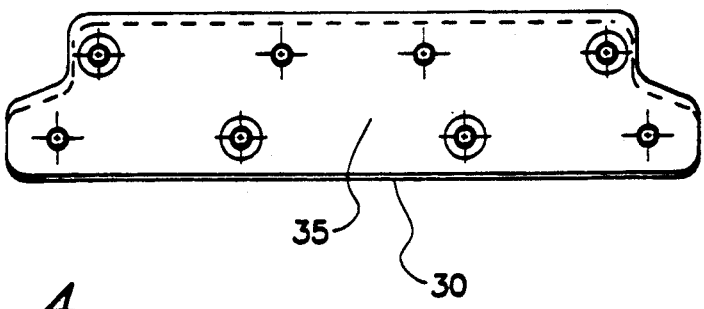
FIG. 4 is the top view of the air cleaner collector section.

FIGS. 4 and 4*a* depict an air cleaner collector section 32 utilized in the electronic air cleaner. Air cleaner collector section 32 consists of high voltage or hot plates 30 and low voltage or ground plates 35. The high voltage plates 30 and the ground plates 35 are alternated in air cleaner collector section 32. In operation, high voltage plates 30 are charged to 4,075 volts dc, ground plates 35 being grounded or at a zero volt potential. For assembly of air cleaner collection section 32, collection plates 30 and 35 are alternately placed in a holding fixture (not shown). Expansion tubes 40, 41, 42, 43, 44, 45, 46 and 47 are passed through both high voltage plates 30 and ground plates 35 and then expanded radially to secure plates 30 and 35. Further, high voltage plates 30 are electrically connected to expansion tubes 40, 43, 44 and 47 such that high voltage plates 30 receive a voltage charge of 4,075 volts dc through expansion tubes 40, 43, 44 and 47 during operation. High voltage plates 30 are cut away such that expansion tubes 41, 42, 45 and 46 do not come in contact with high voltage plates 30. Ground plates 35, conversely, are designed such that ground plates 35 are electrically connected to expansion tubes 41, 42, 45 and 46. However, ground plates 35 are also cut away in such a manner that they are not in contact with expansion tubes 40, 43, 44 or 47. In this manner, a dc voltage differential is achieved between high voltage plates 30 and ground plates 35. The resultant voltage field is utilized to trap ionized particles in the air.

Figure 5A:
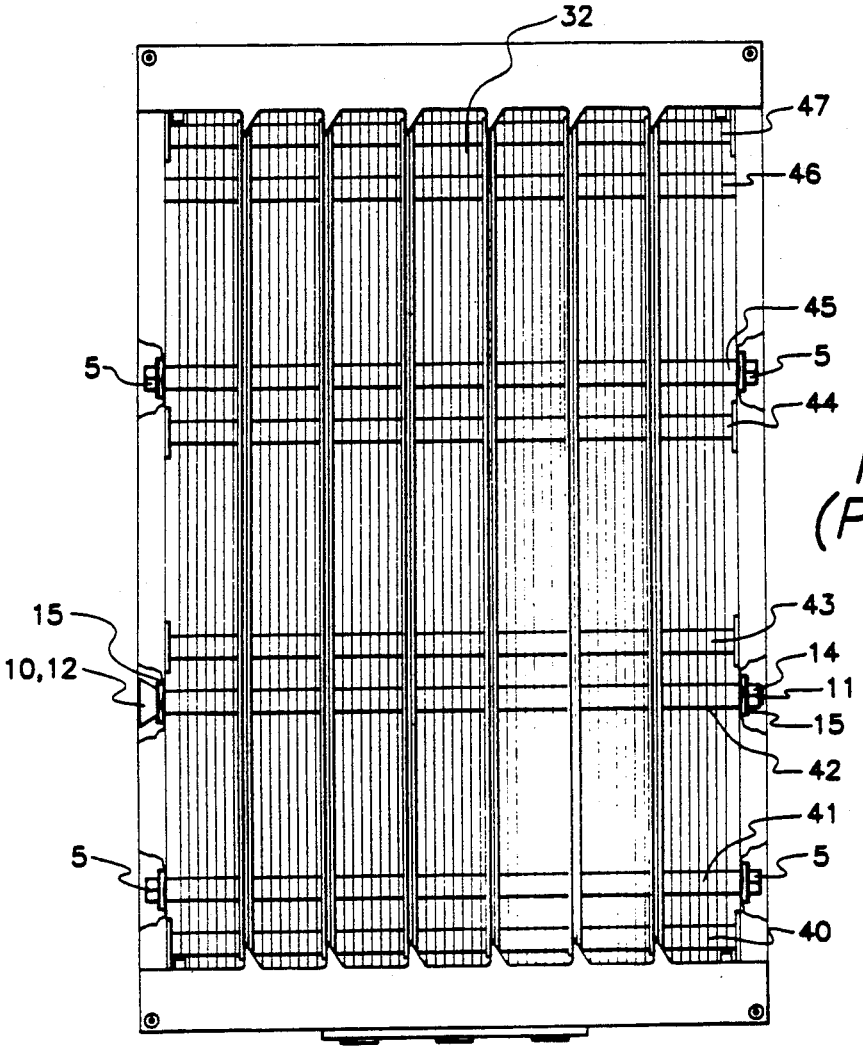
Fig. 5a (Prior Art)
FIG. 5*a* is the front view of the "prior art" electronic air cleaner cell.
Figure 5:
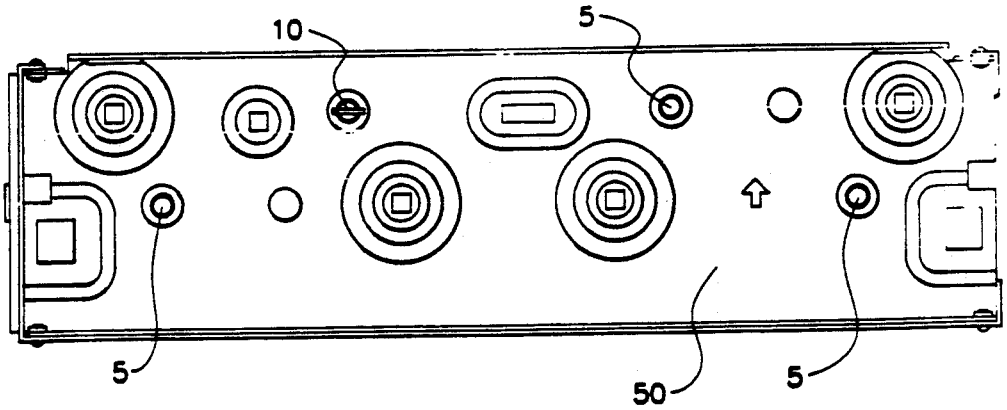
Fig. 5 (Prior Art)
FIG. 5 is the top view of the "prior art" electronic air cleaner cell.

Air cleaner collector section 32 is fastened between two end plates 50 as shown in FIGS. 5 and 5*a*. FIGS. 5 and 5*a* demonstrates the "prior art" methods of fastening end plates 50 to air cleaner collector section 32. Air cleaner collector section 32 when fastened by screws 5, have screws 5 placed through end plates 50 such that screws 5 are screwed into expansion tubes 41, 45 and 46. Normally only expansion tubes 41 and 45 (or 42 and 46) would have screws 5 used to fasten air cleaner collection section 32.

FIGS. 5 and 5*a* further demonstrate expansion tube 42 with tie rod 10 utilized for fastening the air cleaner collector section. As shown in FIGS. 5 and 5*a* tie rod 10 is first passed through a washer 15, through first end plate 50, then expansion tube 42 of air cleaner collector section 32, and then second end plate 50. When tie rods 10 are used to fasten air cleaner collection section 32, expansion tubes 41, 42 and 45 are used. Tie rod 10 is fastened in place by placing a second washer 15 on tie rod 10 and then a nut 14 is torqued onto tie rod 10.

Figure 6A:
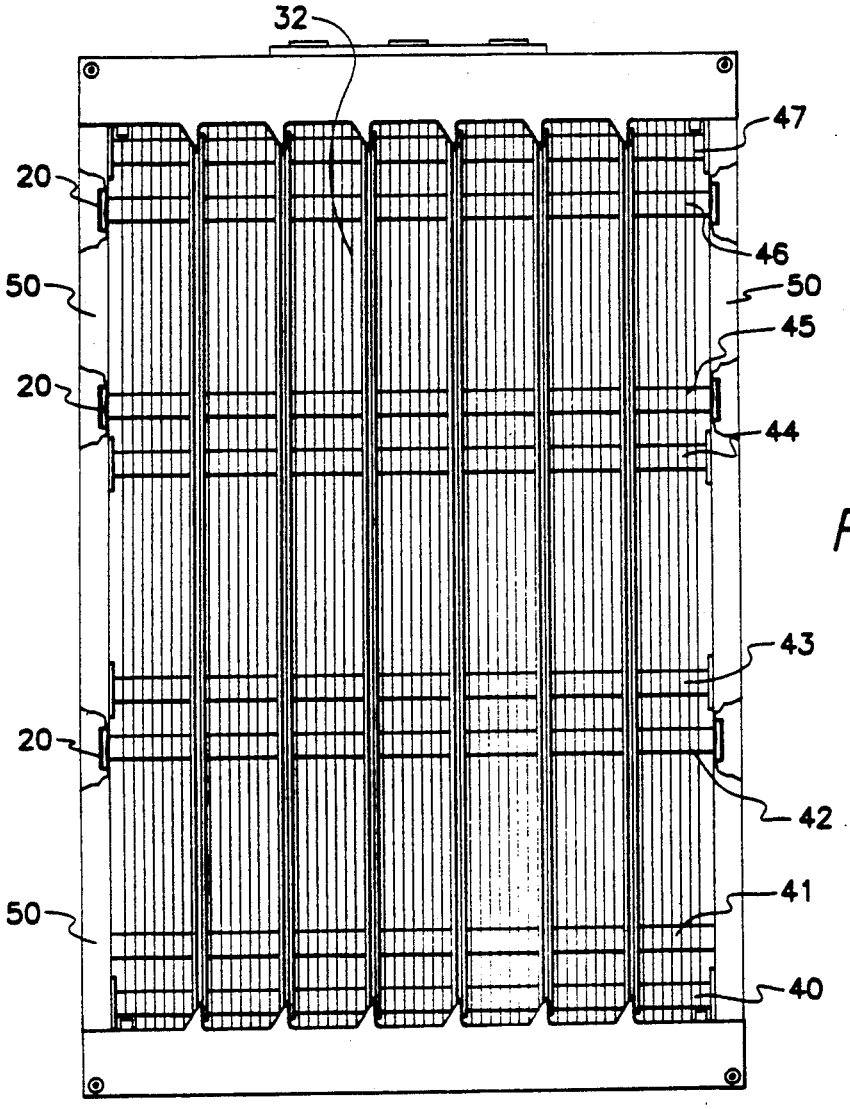
FIG. 6*a* is the front view of the preferred embodiment of the invention.
Figure 6:
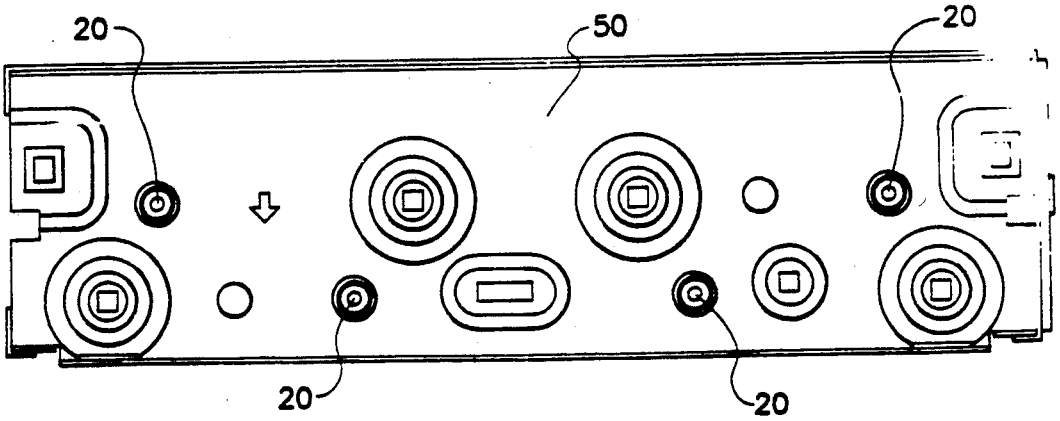
FIG. 6 is the top view of the preferred embodiment of the invention.

FIGS. 6 and 6*a* depict the preferred embodiment of the invention. Flare tubes 20 are inserted through a first end plate 50 and expansion tubes 41, 42, 45 and 46. Although FIGS. 6 and 6*a* shows expansion tubes 41, 42, 45 and 46 filled with flare tubes 20, it is possible to use only expansion tubes 41 and 45 (or 42 and 46). Flare tube 20 has first end 21 which is flared to retain first end plate 50. Flare tube 20 opposing end 25 is inserted through end plate 50 and air cleaner collector section 32. A second end plate 50 is then placed on air cleaner collector section 32 and flare tube 20 is also inserted through second end plate 50. After flare tube 20 is inserted through both end plates 50 and the air cleaner collector section 32, flare tubes 20 are flared at ends 25 using an orbital riveter. An orbital riveter is utilized to prevent buckling of flare tube 20 as it is flared. By using an orbital riveter, dimension consistency without tight tolerances of the flare tubes is possible. This is possible as the orbital riveter continually spins while compressing flare tube 20, allowing equal pressure upon the entire flare tube. This allows flare tubes 20 to be of slightly varying lengths, as the riveter will flare the flare tube 20 until a desired compression of end plates 50 is obtained upon air cleaner collector section 32. The head for the orbital riveter can be obtained from Bracker Corporation of Pittsburgh, Pa.

Flare tubes 20 also add benefits to the air cleaner collector section and the method of manufacture. Flare tube 20 provides additional stiffness to the assembly by supporting the cell expansion tube through which it passes. An additional cost saving advantage is that flare tube 20 can be fastened in place using a fully automatic process significantly lowering the cost of manufacture. Finally, air cleaner cells can be broken down without damaging air cleaner collector section 32 by drilling out flare tube 20. Through use of the flare tube it is possible to make a air cleaner which is subject to a lower failure rate and has a longer life, as a flare tube, unlike the screw and the tie rod, will not come loose.

I claim:

1. An electronic air cleaner comprising:

a) an air cleaner collector section comprising a plurality of plate retaining tubes and a plurality of collection plates, said collection plates being retained by said plate retaining tubes;

b) a first end plate and a second end plate, said end plates being placed at either end of said air cleaner collector section; and c) a plurality of flare tubes, each flare tube of said plurality of flare tubes having a first end and a second end, each said flare tube being passed through said first end plate, one of said plate retaining tubes and said second end plate; said first end and said second end of each said flare tube being flared, wherein said flare tubes retain said first end plate and said second end plate at either end of said air cleaner collection section.

2. A method for manufacturing electronic air cleaners comprising an air cleaner collection section comprising a plurality of plate retaining tubes and a plurality of collection plates, said collection plates being retained by said plate retaining tubes, said method for manufacturing electronic air cleaners comprising:

a) placing a first end plate and a second end plate on said plate retaining tubes;

b) passing flare tubes through said first end plate, said plate retaining tubes, and said second end plate, said flare tubes having a first end and a second end; and c) flaring said first and said second ends of said flare tubes, wherein said flare tubes retain said first end plate and said second end plate at either end of said air cleaner collection section.

* * * * *